US005721467A

United States Patent [19]

Zhang et al.

[11] Patent Number: 5,721,467

[45] Date of Patent: Feb. 24, 1998

[54] QUANTUM INCLUSION EFFECT LATERAL FIELD EMITTER

[75] Inventors: Li Zhang, Inagi; Tadashi Sakai, Yokohama; Tomio Ono, Yokohama; Takashi Yamauchi, Yokohama, all of Japan

[73] Assignee: Kabushiki Kaisha Toshiba, Kanagawa-ken, Japan

[21] Appl. No.: 707,454

[22] Filed: Sep. 4, 1996

[30] Foreign Application Priority Data

Sep. 5, 1995 [JP] Japan ..... 7-227989

[51] Int. Cl.[6] ..... H01J 1/30; H01J 19/24

[52] U.S. Cl. ..... 313/310; 313/309; 313/336; 313/496; 257/10

[58] Field of Search ..... 313/309, 351, 313/336, 495, 496, 497, 310, 366, 368, 367; 257/10

[56] References Cited

U.S. PATENT DOCUMENTS

| | | | |
|---|---|---|---|
| 5,308,439 | 5/1994 | Cronin et al. | 313/336 |
| 5,384,509 | 1/1995 | Kane et al. | 313/309 |
| 5,610,471 | 3/1997 | Bandy et al. | 313/309 |

OTHER PUBLICATIONS

C.A. Spindt et al., "Physical Properties of Thin-Film Field Emission Cathodes with Molybdenum Cones", J. Appl. Phys., 47(12):5248–5263 (1976) (no month).

S. Bandy et al., "Complete Vacuum Microelectronic Structures Using GaAs", Proc. IEDM, pp. 375–378 (1992). (Dec).

T. Oshima et al., *Electron Beam Emission From GaAs Field Emitter Covered with GaAs/A/As Superlattice*, J. Soc. Appl. Phys., Abstract 30p–T–14 (1995) (no month).

*Primary Examiner*—Michael Horabik
*Assistant Examiner*—Michael Day
*Attorney, Agent, or Firm*—Finnegan, Henderson, Farabow, Garrett & Dunner, L.L.P.

[57] ABSTRACT

A field emission cold cathode is disclosed which comprises a first thin film formed of an emitting material and second thin films differing in composition from the first thin film, wherein the second thin films are superposed one each on the main surfaces of the first thin film to form a laminated structure, the lateral sides of the laminated structure expose the lateral end parts of the first thin film and the second thin films, and the exposed end parts of the first thin film emit electrons under an electric field. A method for the production of the cold cathode is also disclosed.

8 Claims, 13 Drawing Sheets

QUANTUM INCLUSION EFFECT LATERAL FIELD EMITTER

BACKGROUND OF THE INVENTION

1. Field of the Invention

This invention relates to a field emission cold cathode and a method for the manufacturing thereof.

2. Description of the Related Art

In recent years, the miniature cold cathodes using the micromachining technology that has been growing with a view mainly to the development of semiconductor integrated circuits are being energetically promoted. As a typical example of these miniature cold cathodes, the field emission cold cathode which was proposed by C. A. Spindt et al. (Journal of Applied Physics, vol. 47, 5248, 1976) is well known.

This field emission cold cathode is represented in FIG. 18. As illustrated in the diagram, the field emission cold cathode is composed of a substrate 1 such as is formed of Si, an emitter 2 such as is formed of Mo as disposed on the substrate 1, an oxide film 3 such as is formed of $SiO_2$, and a gate electrode 4 such as is formed of Mo. The emitter 2 is shaped in a substantially triangular cross section so as to form a leading end as sharply pointed as permissible.

The field emission cold cathode mentioned above has been the subject of an increasingly energetic study encouraged by the expectations for an application to devices of novel principles. Studies have been so far initiated for exploring the application of the field emission cold cathode to ultrahigh frequency devices, flat displays, light sources, and sensors, for example. Expectations are gathering at the development of a device that harnesses the feature of the electron source thereof and surpasses the limits of solid state devices of semiconductors.

The theory of Fowler-Nordheim is utilized as the principle of the field emission devices. This theory indicates that the emission current is determined by the work function of the emitter material and the field strength of the part for radiating electrons.

For the purpose of heightening the emission current, the method which decreases the work function by using a material of low affinity, decreases the radius of curvature of the leading end of the emitter by adjusting the shape thereof, and heightens the field strength by causing the other electrode to approach the emitter until the distance therebetween reaches the order of submicrons is followed.

The basic structure of the conventional field emission cold cathode consists in an array of a multiplicity of pairs each formed of a sharply pointed emitter of a metal or a semiconductor and a gate disposed so closely to the leading end of the emitter as to induce an intense electric field at the leading end. As respects the process of manufacture, the vacuum deposition method or the sputtering method is used more often than not where the material is a metal or the method for cutting the components from a single crystal by etching is used where the material is a semiconductor.

The structure and process of manufacture of the conventional field emission cold cathode mentioned above, however, encounter the following serious problems.

Firstly, the field emission cold cathode mentioned above inevitably requires to regulate dimensionally the shaping of the leading end part of an emitter accurately to the order of nanometers to ensure necessary concentration of the electric field at the leading end of an emitter. Even with the existing micromachining technology, however, it is difficult to produce the emitters in uniform structure because the produced emitters tend to be dispersed in terms of height and shape of the leading end.

The currents radiated from the emitters are very sensitive to the structures of the emitters. The possible dimensional dispersion produces the state in which only part of the array of pairs is allowed to operate and entails the problem of decreasing the currents of field emission.

Since the shape of the array of emitters is undulated, the distances from the leading ends of the emitters in the array to the corresponding gate electrodes to be formed subsequently are regulated with difficulty. Thus, the process of manufacture of the array not only suffers from poor repeatability and yield but also lacks conformity with the LSI planar technology.

Secondly, since the emitters require their leading ends to be sharply pointed, the process of manufacture varies with the kind of the material to be used for the emitters. The process in itself, therefore, lacks versatility and consequently incurs the problem of boosting the cost for mass production.

Thirdly, since the work function is governed by the kind of a material to be used, even the material which excels in such characteristics for a vacuum element as the adaptability for a microstructure and the adequacy as a vacuum material cannot be safely used for the emitters so long as the work function of the material is high. The emitters consequently have a limited selection of materials.

Fourthly, since the electrons to be emitted have an expanded energy band, the field emission cold cathode has the problem that it will not be perfectly proper for use in ultrahigh frequency devices.

As described above, the field emission cold cathode of the conventional structure incurs many problems such as insufficient and ununiform efficiency of field emission, unduly low yield of production, and poor compatibility with the planar technology because the emitters thereof obtained by machining have shapes that are deficient in repeatability and uniformity and the gate electrodes thereof obtained by forming have shapes that are poor in controllability.

The conventional field emission cold cathode also entails such problems as variability of the method of manufacture with the kinds of materials to be used, sparing adaptability for mass production from the viewpoint of process, and high cost of production.

Further, the selection of the materials for the cold cathode is restricted by the work function and the properties for a vacuum device other than the work function have only little room for selection.

SUMMARY OF THE INVENTION

This invention has been produced for the purpose of solving the problems mentioned above. The first object of the present invention is to provide a field emission cold cathode that allows an enlarged range of materials for selection as compared with the conventional field emission cold cathode and a method for the production thereof.

The second object of this invention is to provide a field emission cold cathode that permits the efficiency of field emission to be exalted and uniformized and enables the uniformity of energy to be improved and a method for the production thereof.

The third object of this invention is to provide a field emission cold cathode that abounds in adaptability for mass production and a method for the production thereof.

The first field emission cold cathode of this invention that fulfills the objects of this invention described above comprises a first thin film formed of an emitting material and second thin films differing in composition from the first thin film, wherein the second thin films are superposed one each on the main surfaces of the first thin film to form a laminated structure, the lateral sides of the laminated structure expose the lateral side end parts of the first thin film and the second thin films, and the exposed end parts of the first thin film emit electrons under an electric field.

The first field emission cold cathode of this invention is further characterized in that the first thin film is formed of a narrow band gap semiconducting material and the second thin films are formed of a wide band gap semiconducting material and the first thin film is so constructed as to have a Fermi level higher than the bottom of the conduction band and manifest a diminished actual work function.

The first field emission cold cathode of this invention is also characterized in that the first thin film is formed of a metallic material and the second thin films are formed of a dielectric material.

Then, the field emission cold cathode mentioned above is characterized by the first thin film being formed in a thickness for allowing the thin film to produce a quantum inclusion effect, enabling the energy of electrons to be quantized, and permitting emission of electrons of uniform energy.

The method for the production of the field emission cold cathode of this invention is characterized by comprising a step of forming a thin-film laminated structure by having thin films of a narrow band gap semiconducting material and thin films of a wide band gap semiconducting material alternately superposed in a plurality of layers, a step of forming supporting members one each on the lateral side parts of the thin-film laminated structure, and a step of forming electrodes one each in the bottom part and the top part of the thin-film laminated structure.

In this invention, the emitter layers measuring in the order of nanometers can be formed as well controlled by using such a crystal lamination technique as MBE in laminating the thin films and utilizing the end faces of the superposed thin films as emitters without requiring the emitters to be machined in a stated shape. As a result, an array of emitters which incur no dimensional dispersion and excel in uniformity and repeatability can be formed and highly efficient field emission characteristics can be acquired.

In the emitters that measure in the order of nanometers, the electrons are caused by the quantum effect to assume discrete values of energy. Consequently, the electrons released from the emitters assume very narrow and sharp discrete values of energy. By using an energy spectroscope resorting to a magnetic field, therefore, an ultrahigh speed device can be realized.

The electrons are included in the emitters by using a narrow band gap semiconducting material for the thin films destined to form the emitters and a wide band gap semiconducting material for the thin films serving to nip the emitter layers. The emitters, by having the Fermi level thereof elevated above the bottom of the conduction band, are endowed with metallic characteristics and allowed to enjoy a generous decrease in the actual work function and consequently acquire highly efficient field emission characteristics proper for driving at low voltage.

By adopting the crystal lamination technique, a wide range of materials including those of high levels of work function are made usable for the emitters, with the result that the process for manufacture will gain in versatility, the cost for mass production will decrease, and the compatibility with the semiconductor planar technique will improve.

DESCRIPTION OF THE PREFERRED EMBODIMENTS

Figure 1A:
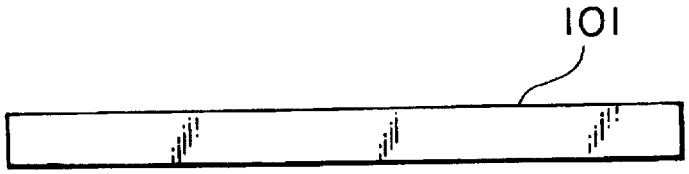
FIG. 1A, FIG. 1B, FIG. 1C, FIG. 1D, and FIG. 1E are diagrams illustrating the steps in the process for the production of electrodes for the field emission cold cathode of this invention.

Now, the embodiments of the field emission cold cathode of this invention will be described below.

As the emitting material in this invention (the material for the first thin film in this invention), a semiconducting material or a metallic material can be used.

In the case of the semiconducting material, the array of emitters can be formed by superposing layers of a compound belonging to Groups 3–5 or Groups 2–6 or of a single crystal or a mixed crystal of a compound of Group 4.

As concrete examples of the narrow band gap and wide band gap compositions, such combinations as GaAs/AlGaAs, InP/GaInAs, InGaAs/InAlAs, GaAs/AlAs, InAs/GaSb, GaP/GaAsP, ZnSe/ZnTe, ZnS/ZnSe, Si/SiGe, and Si/SiC may be cited.

In the case of the metallic material, such metals as Mo, W, Hf, Pt, Au, Nb, Cr, and Ta can be used. For the interface insulating films, such insulating compounds as $SiO_2$ and $A1_2O_3$ can be used.

As the planar emitter array, a section formed in a laminate which is produced by alternately superposing layers of a narrow band gap material, several nanometers in thickness, and layers of a wide band gap material, somewhere in the order of submicrons in thickness, can be used.

Where the semiconducting material is used, the Fermi level of the emitter materials can be controlled and the work function thereof can be simultaneously controlled by adjusting the sizes of the wide band gap materials and doping these material with an impurity. As a result, the operation at low voltage and the high efficiency of field emission can be attained.

In the case of the semiconductor emitters, the lateral micromachining technique can be adopted besides the lamination technique. Specifically, by the lithographic technique using EB, FIB, or X-ray, the semiconductor emitters can be machined in a fine patterning of the quantum size.

The thin-film emitters in the field emission cold cathode of this invention show no sign of dimensional dispersion because the thin films, during the course of formation, can be dimensionally controlled accurately to the order of nanometers by the crystal lamination technique without requiring any control of shape. As a result, this invention can provide a planar field emission cold cathode that excels in structural uniformity and repeatability and fulfills such requirements as the ability to operate at low voltage and the highly efficient field emission characteristics.

Further, the use of a semiconducting material for the emitters enables electrons to be included in the emitter layers and permits a generous decrease in the actual work function. Since a wide range of semiconducting materials including those of high work function are usable for the emitters, this invention can provide a field emission cold cathode which operates at low voltage and manifests highly efficient emission.

The emitter layers measure in the order of nanometers in thickness and the electrons released thereby have quantized discrete values of energy, namely energy dispersion is small so that signal to noise ratio is drastically decreased. Therefore, the field emission cold cathode of this invention can be applied to an ultrahigh speed device, and the like.

Embodiment 1

FIG. 1A, FIG. 1B, FIG. 1C, FIG. 1D, and FIG. 1E illustrate the steps in the process for the production of the field emission cold cathode of this invention. This embodiment is depicted as using GaAs as a narrow band gap material and AlGaAs as a wide band gap material for semiconductors. Now, the steps of production will be described below with reference to the diagrams.

First, an n type GaAs substrate 101 which had undergone a surface treatment by the standard washing generally performed on a semiconductor wafer is prepared as shown in FIG. 1A.

Figure 1B:
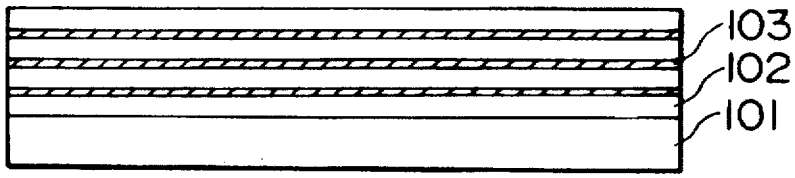

Then, a laminated structure is formed by alternately superposing a plurality of AlGaAs layers 102 and as many GaAs layers 103 by such a film forming technique as the MBE (molecular beam epitaxy) method as shown in FIG. 1B. Appropriately, the GaAs layers 103 each have a thickness of about 10 nm and the AlGaAs layers 102 a thickness in the approximate range of 100~300 nm. For the AlGaAs layers 102 and the GaAs layers 103 alike, the impurity doping level can be freely varied in the range of $2E15/cm^3$ ~$5E18/cm^3$ to suit the purpose.

Figure 1C:
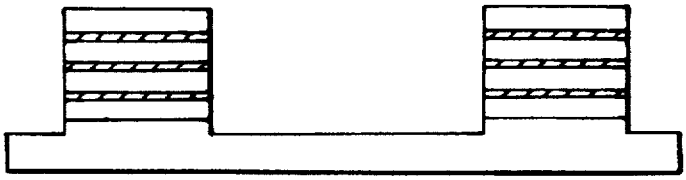

Then, after covering semiconductors laminated side of the substrate with photo-resist, patterning technique such as RIE (reactive ion etching) is applied to get mesa-type pattern as shown in FIG. 1C. The patterns can be any one of squares, lines, circles, and others.

Figure 1D:
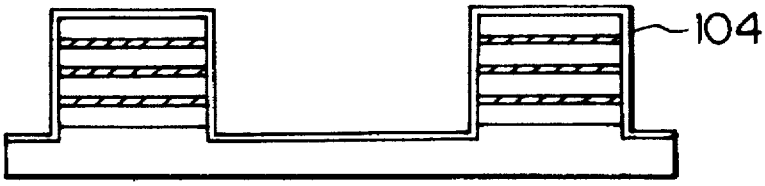

Then, a metal layer (104) to be used as electrode is deposited using such a method as CVD, sputtering, and vapor deposition on the etched surface including the lateral parts of the laminated composite as shown in FIG. 1D.

Figure 1E:
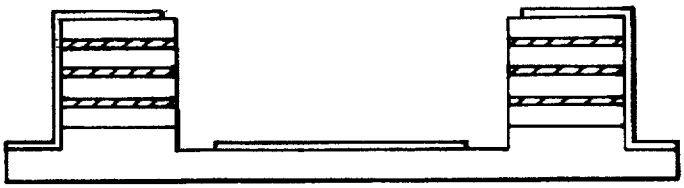

Then, after covering the metal deposited surface with the photo-resist, the RIE technique is applied onto the laminated composite to expose electron emitting surface. Here, over-etching the deposited metal layer into the laminated layers gives cleaner surface of the laminated layers of any desired area (FIG. 1E).

Figure 2:
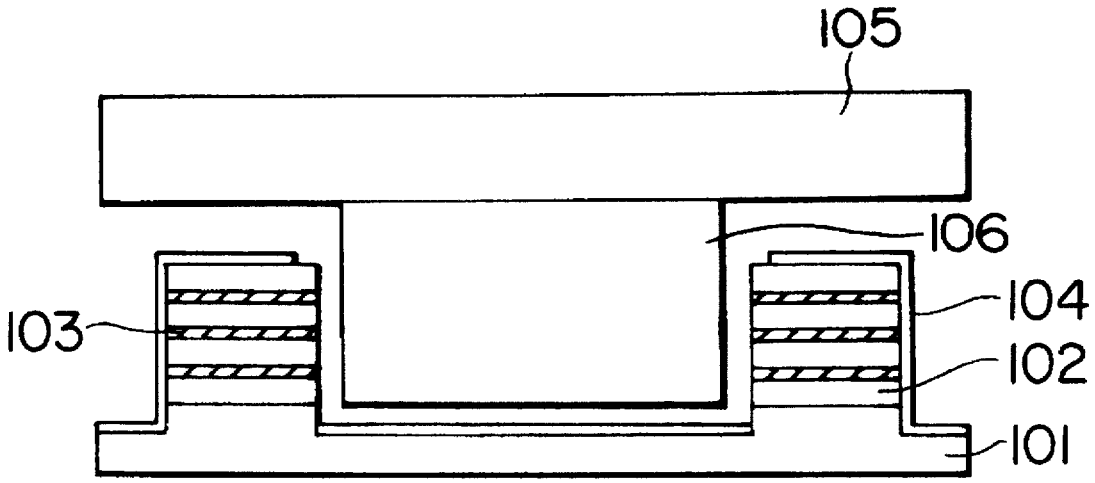
FIG. 2 is a diagram illustrating the structure of electrodes in the field emission cold cathode of this invention.

Then, anode (106) is made on a separate substrate (105) and is faced to the cold cathode prepared previously as shown in FIG. 2.

In the structure obtained consequently, the electrons are included in the GaAs layers 103 of a narrow band gap, 10 nm in thickness, the GaAs layers 103 function as emitters, and the AlGaAs layers 102 of a thick wide band gap function as potential barriers.

When an external electrode 106 is opposed to the lateral side of the laminated structure mentioned above as illustrated in FIG. 2 which represents the structure of the field emission cold cathode of this invention and this external electrode 106 is operated to apply an electric field to a sample, the GaAs layers 103 including the electrons are caused to concentrate the electric field onto them and consequently release the electrons under the electric field.

Figure 3:
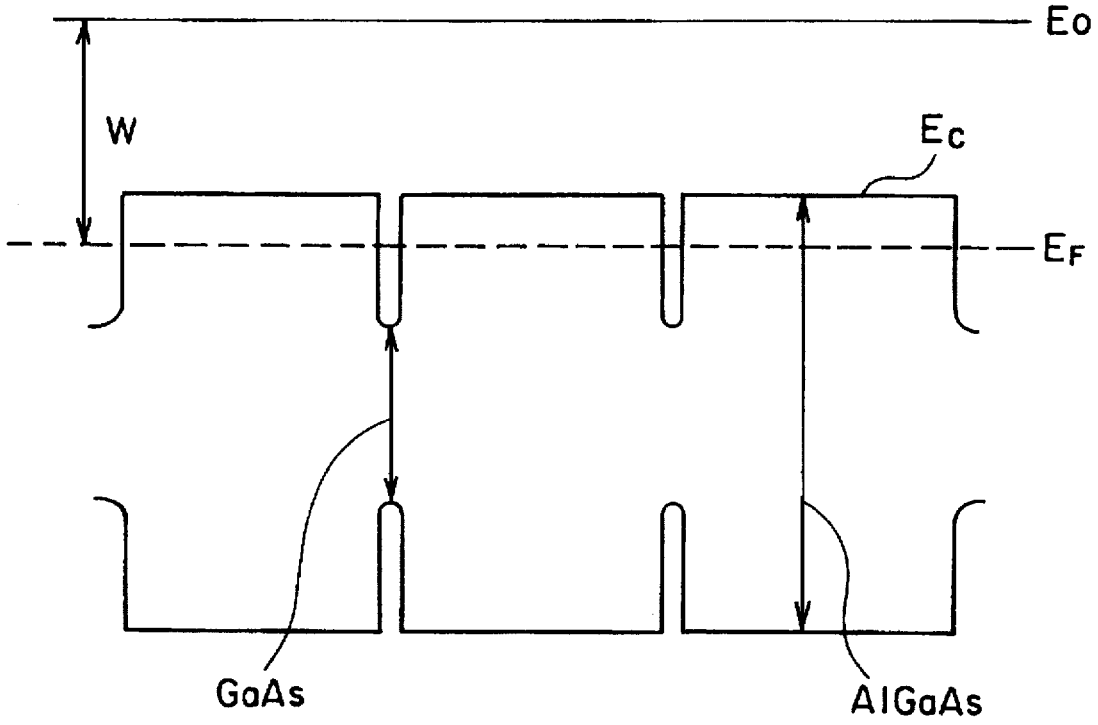
FIG. 3 is a diagram showing the energy band manifested by the field emission cold cathode of this invention while the cathode is in the state of actual operation.

FIG. 3 depicts an artist's concept of the energy band involved in the structure mentioned above. In this diagram, E0 stands for the vacuum sublevel and EF for the Fermi level.

From FIG. 3, it is noted that the electrons are included in the GaAs layers 103, 10 nm in thickness, the Fermi level EF is elevated far above the bottom of the conduction band of the GaAs layers 103, the actual work function W of the GaAs layers 103 is generously lowered, the characteristics thereof are varied like a metallic substance, and the cold cathode is enabled to operate as an electrode fit for driving at low voltage. Further, owing to the quantum inclusion effect, the energy level of the electrons in the GaAs layers 103 assumes a quantized discrete values and the electrons emitting under the electric field are allowed to assume a uniform energy.

Now, the band structure and energy level determined by a theoretical calculation and the results of simulation of the electron distribution are shown in FIG. 4 ~FIG. 14. The thickness of the AlGaAs layers as the potential barrier layers, the doses of impurity Si respectively in AlGaAs and GaAs, and the number N of the emitter layers are varied as parameters.

Figure 4:
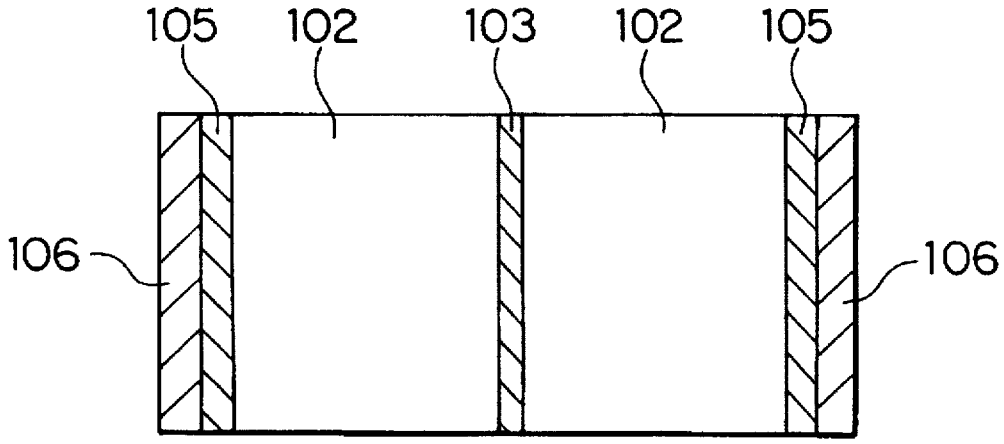
FIG. 4 is a diagram illustrating the schematic structure of a field emission cold cathode engaging in a theoretical calculation.

In the case of a single-layer emitter (N=1) shown in FIG. 4, the AlGaAs layers 102 have a thickness of 100 nm, the GaAs layer 103 has a thickness of 10 nm, and the high purity GaAs layer 103 has been doped with an impurity level of $2E15/cm^3$ as modulated to AlGaAs.

The highly doped GaAs layers 105 are formed one each on the opposite main surfaces of the laminated structure and allowed to establish an ohmic contact with the metal (A1) layers. The results of the band calculation are shown in FIG. 5.

The expression "modulated doping" as used herein means a phenomenon in which the electrons are included in the GaAs layer 103 of a narrow band gap by doping the AlGaAs layers 102 of a wide band gap with the impurity substance. The Fermi level of the GaAs layer 103, therefore, can be controlled by the magnitude of the dose of the impurity substance used in the AlGaAs layers 102.

Figure 5:
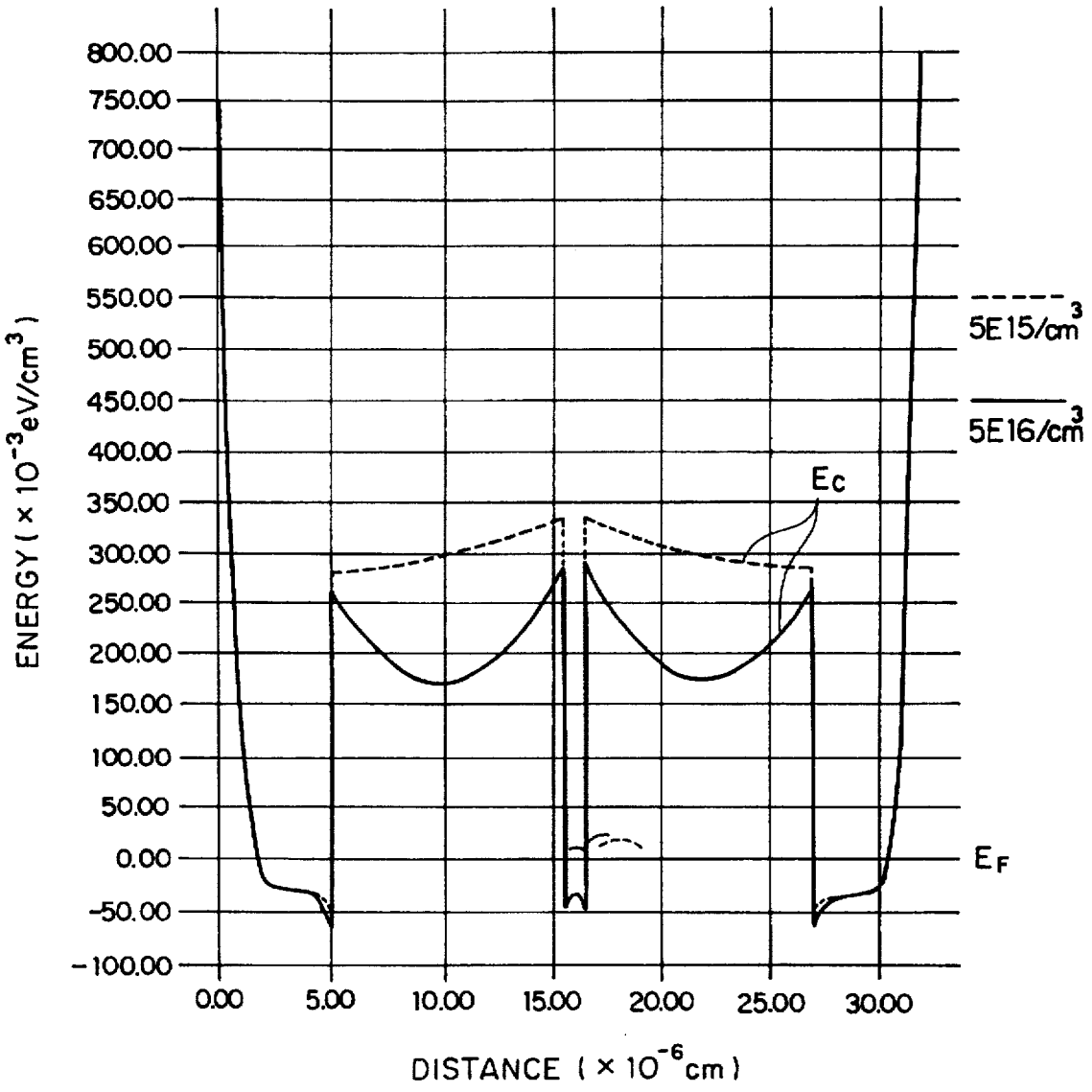
FIG. 5 is a diagram showing an energy band manifested by the field emission cold cathode of FIG. 4.

In FIG. 5, the dotted line represents a band pattern obtained when the dose of an impurity substance in the AlGaAs layers 102 is 5E15/cm$^3$ and a solid line a band pattern obtained when the dose of an impurity substance in the AlGaAs layers 102 is 5E16/cm$^3$. It is clearly noted from this diagram that the Fermi level EF has a higher energy level from the bottom EC of the conduction band in the case of the higher dose of 5E16/cm$^3$. The results support an inference that the electrons are included in the GaAs layer 103.

Figure 6:
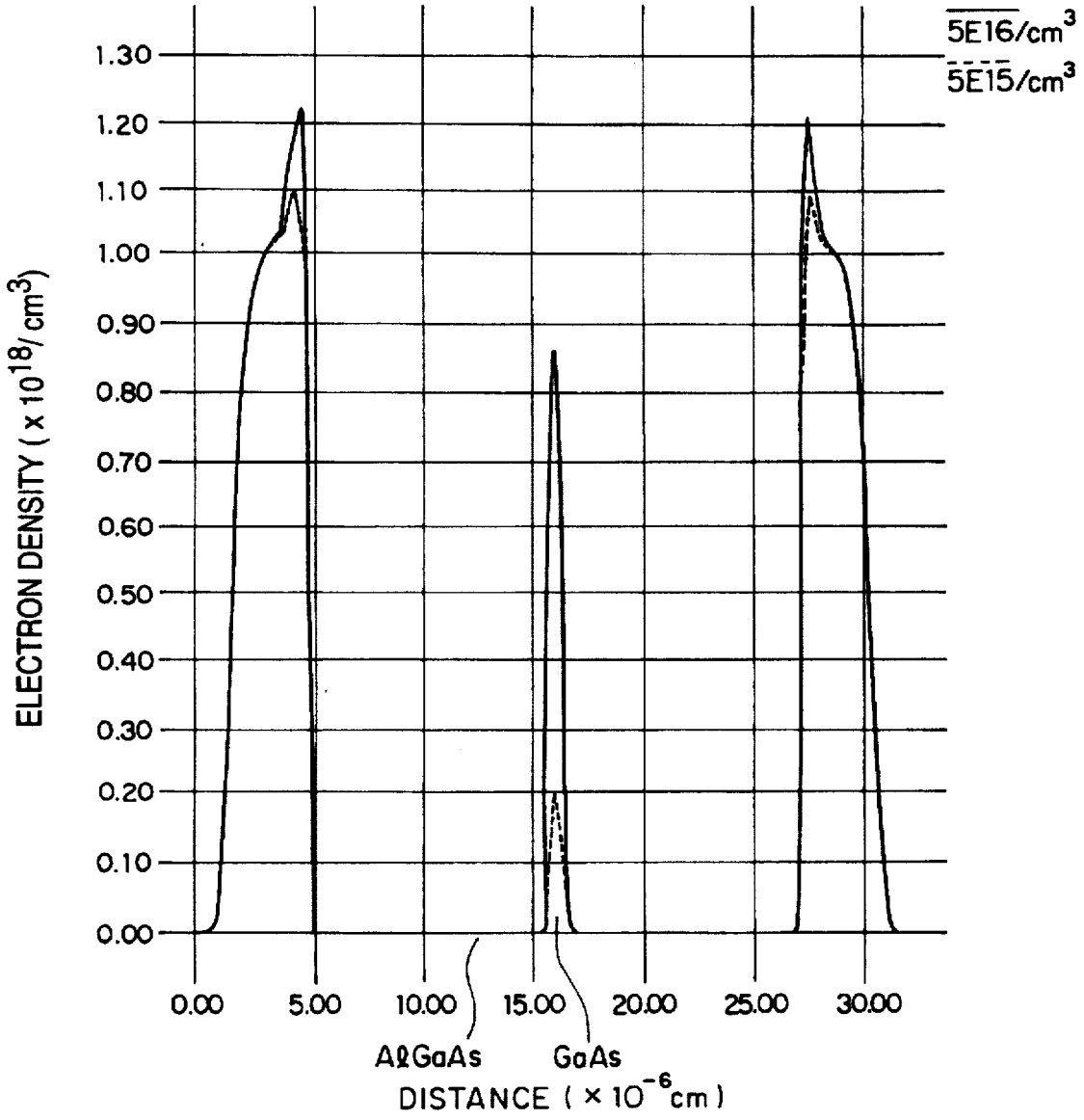
FIG. 6 is a diagram showing an electron density distribution manifested by the field emission cold cathode of FIG. 4.

The results of actual calculation of the electron density distribution are shown in FIG. 6. It is noted from this diagram that the electrons are present only in the GaAs layer 103 as described above and that the electron density of the GaAs layer 103 increases in proportion as the dose of an impurity substance in the AlGaAs layers 102 increases.

Now, the work function of the GaAs layer 103 is calculated. Since the GaAs layer 103 has a high purity, the inherent Fermi level EF thereof falls substantially at the center of the band and the work function thereof equals the energy height from the Fermi level EF to the vacuum level E0. Roughly, this work function is the sum of the electron affinity x and the difference (EC - EF).

In the case of GaAs, since x=4.07 eV and (EC - EF)= EG/2=0.715 eV, the work function W is found to be about 4.78 eV. In the formula, EG stands for a band gap energy of GaAs.

It is noted that in the case of the GaAs layer which has undergone modulated doping, EF surpasses EC and W approximates to 4.02 eV, a value 0.76 eV less than the original value.

From the results of the calculation given above, it is justly concluded that the electrons can be included in the GaAs material of a narrow band gap and, at the same time, the apparent work function W of GaAs can be decreased by controlling the composition. When an external electric field is applied, therefore, the electric field is concentrated in the GaAs layer 103 destined as an emitter and the driving at low voltage is realized in consequence of the decrease in the work function.

The planar field emission array of emitters can be formed as described above.

Figure 7:
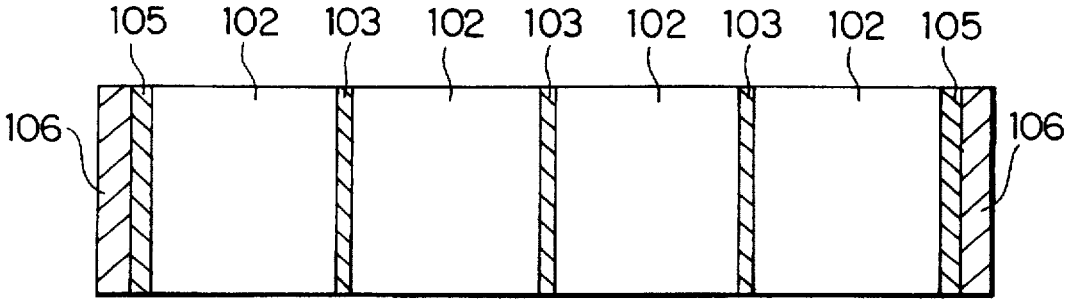
FIG. 7 is a diagram illustrating the schematic structure of a field emission cold cathode engaging in a theoretical calculation.

Now, the results of simulation of the structure using three GaAs emitter layers 103 (N=3) as shown in FIG. 7 will be described below.

The AlGaAs layers 102 and the GaAs layers 103 have the same thicknesses, 100 nm and 10 nm, as in the structure of FIG. 4 described above and the doping levels thereof are respectively 5E16/cm$^3$, a value of high doping, and 2E15/cm$^3$, a value of high purity.

Figure 8:
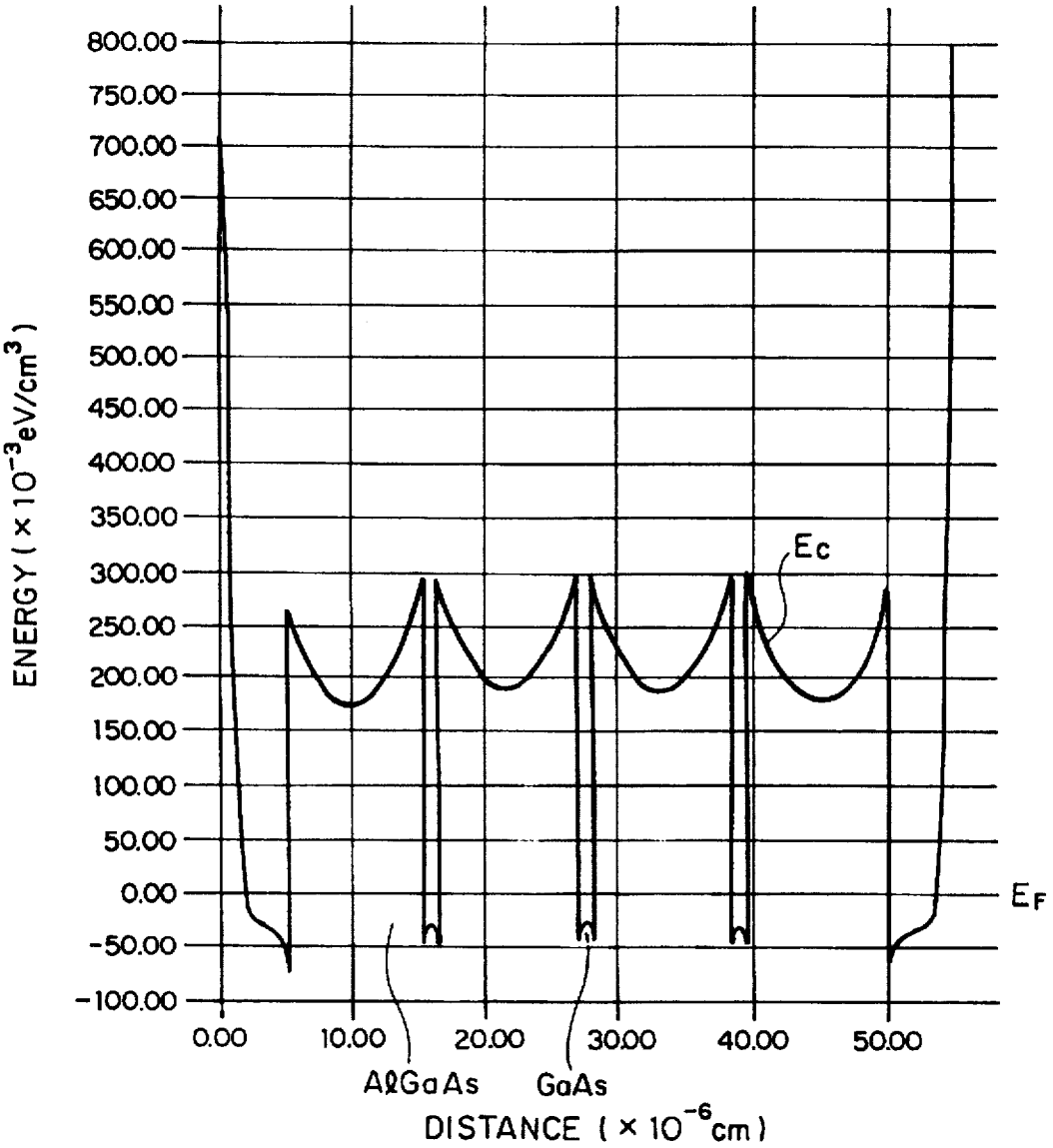
FIG. 8 is a diagram showing an energy band manifested by the field emission cold cathode of FIG. 7.
Figure 9:
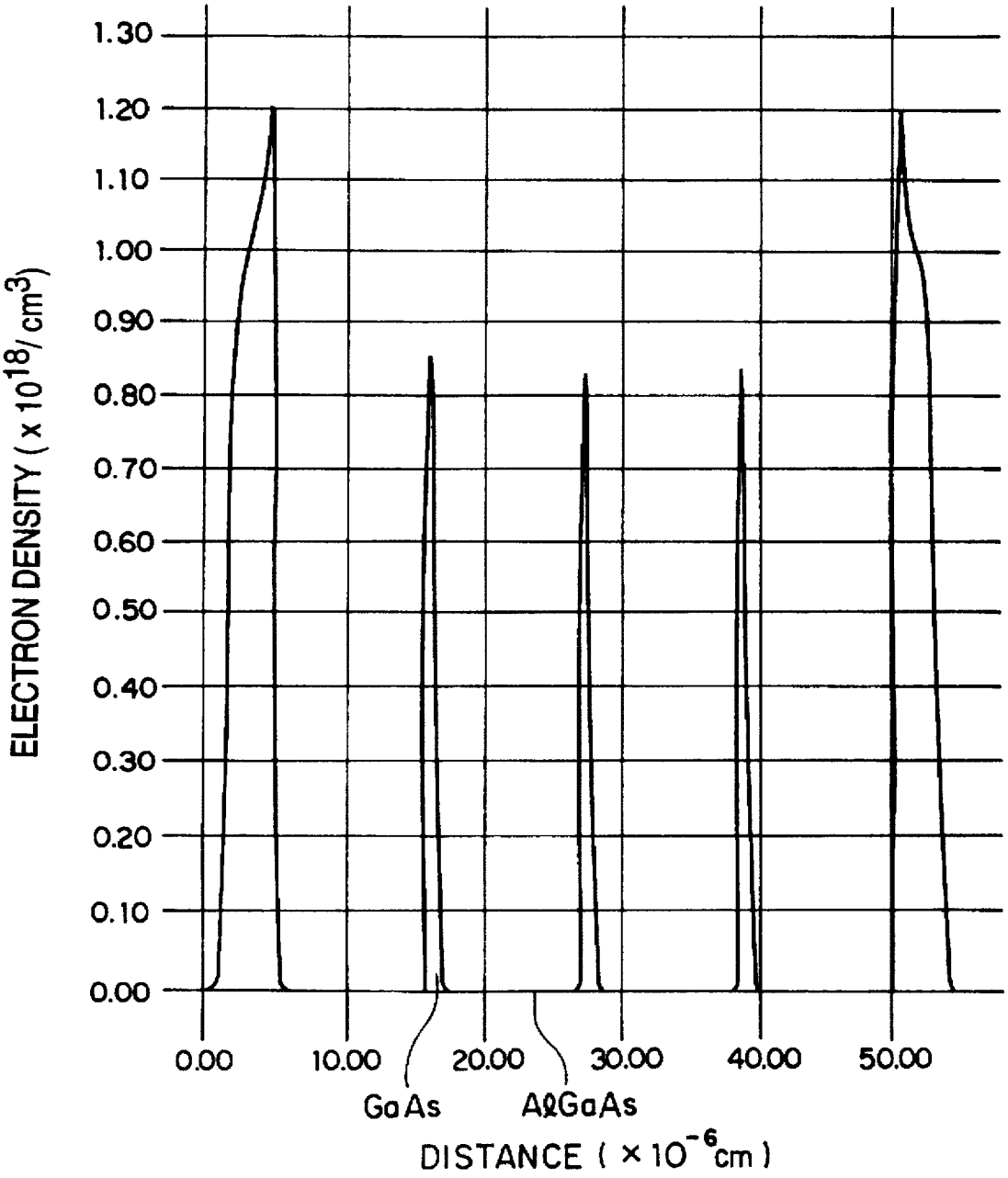
FIG. 9 is a diagram showing an electron density distribution manifested by the field emission cold cathode of FIG. 8.

The results of calculation of a band pattern is shown in FIG. 8 and the results of calculation of an electron density distribution in FIG. 9. It is noted from FIG. 8 and FIG. 9 that, in the structure of the three layers, the electrons are present only in the GaAs layers 102 and the work function is apparently decreased consequently as in the structure of one layer. This fact implies that a planar emitter array can be formed with a multilayer structure.

Figure 10:
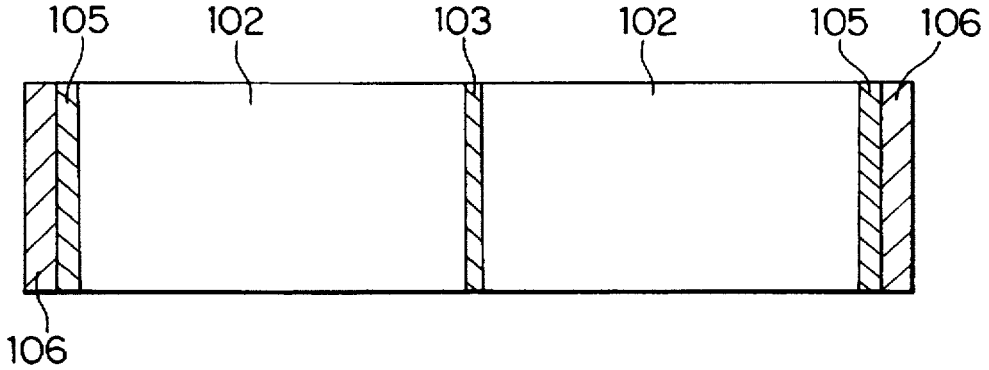
FIG. 10 is a diagram illustrating the schematic structure of a field emission cold cathode engaging in a theoretical calculation.
Figure 11:
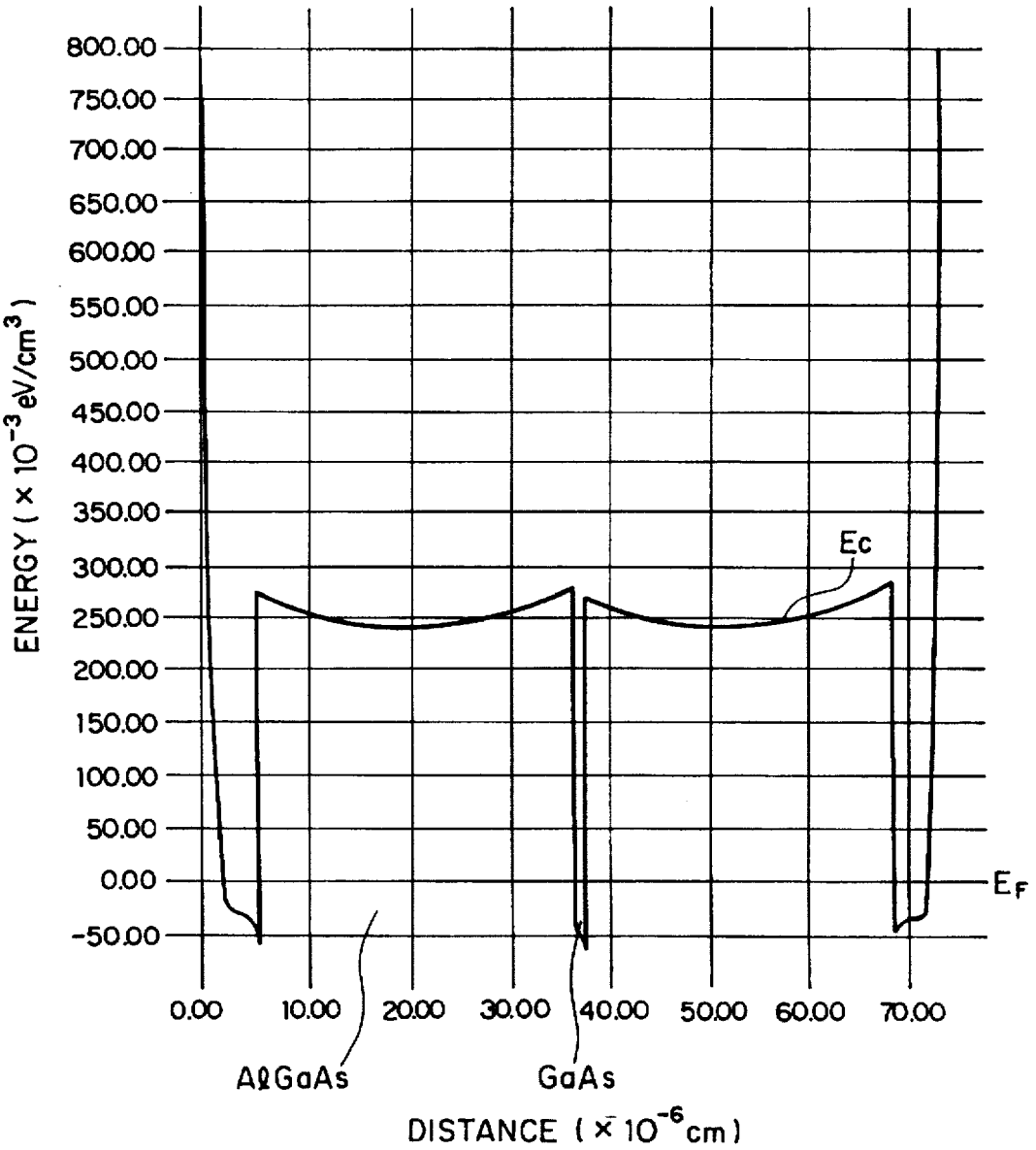
FIG. 11 is a diagram showing an energy band manifested by the field emission cold cathode of FIG. 10.
Figure 12:
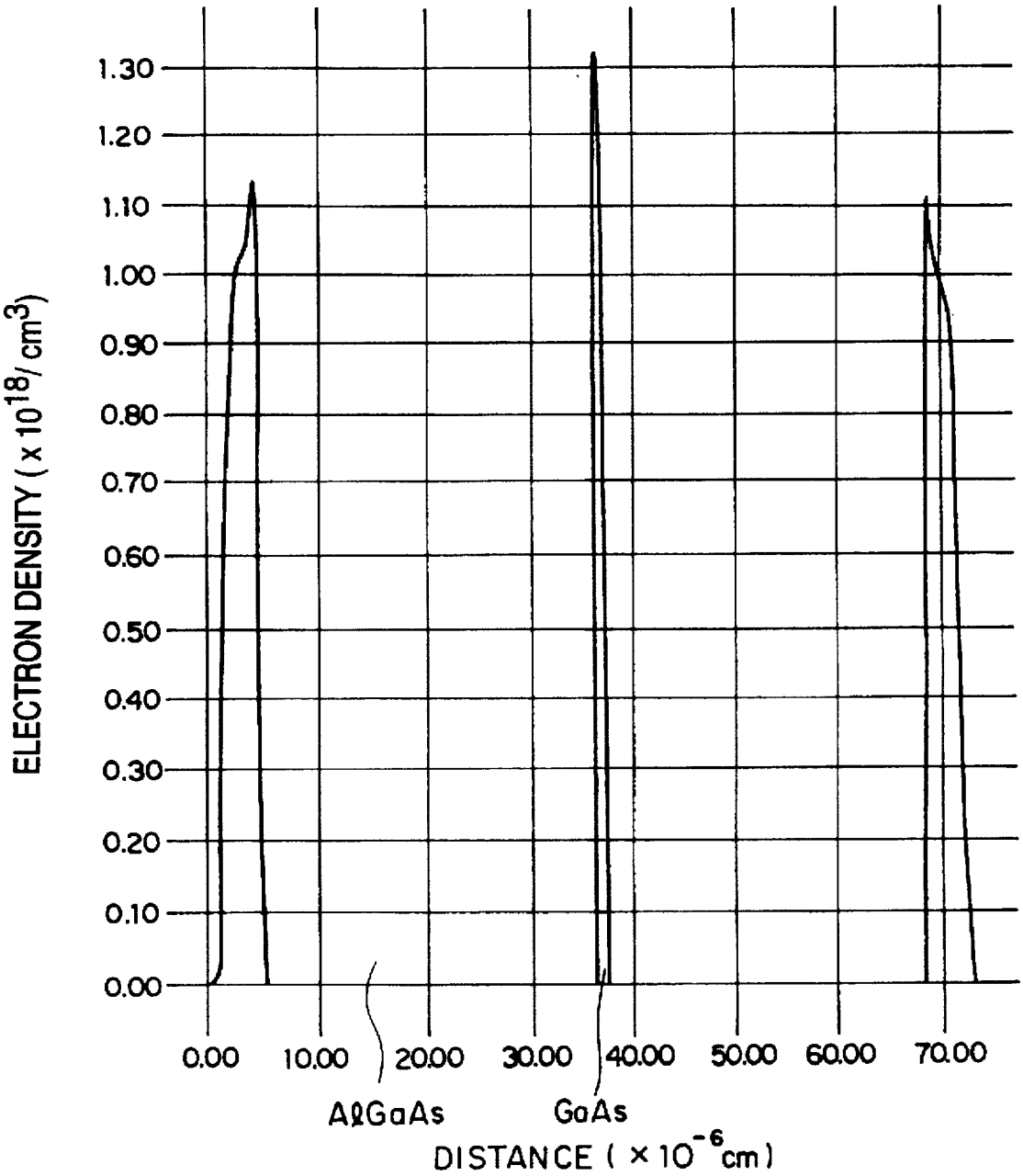
FIG. 12 is a diagram showing an electron density distribution manifested by the field emission cold cathode of FIG. 10.

In the structure shown in FIG. 10, the AlGaAs layers 102 have a thickness of 300 nm and the GaAs layer 103 has a thickness of 10 nm. The energy band pattern which is obtained when the AlGaAs layers 102 are doped with an impurity at a dose of 2E15/cm$^3$, a value of high purity, and the GaAs layer 103 is doped with the impurity at a dose of 5E18/cm$^3$, a value of high doping is shown in FIG. 11. The electron density distribution is shown in FIG. 12.

It is clearly noted from these diagrams that when the AlGaAs layers 102 have a high purity and a thickness of 300 nm and the GaAs layer 103 has a high doping, the electrons can be caused to exist only in the GaAs layer 103 as in the case described above.

According to this invention, the electrons can be included in the emitter materials and the planar emitter array showing no sign of dimensional dispersion and excelling in structural uniformity and repeatability can be formed and enabled to acquire highly efficient field emission characteristics fit for driving at low voltage by controlling the emitter composition accurately to a degree in the order of nanometers by the lamination technique without requiring the emitters to be machined in a stated shape as described.

Embodiment 2

Now, an embodiment using materials different from GaAs and AlGaAs mentioned above will be described below.

Figure 13:
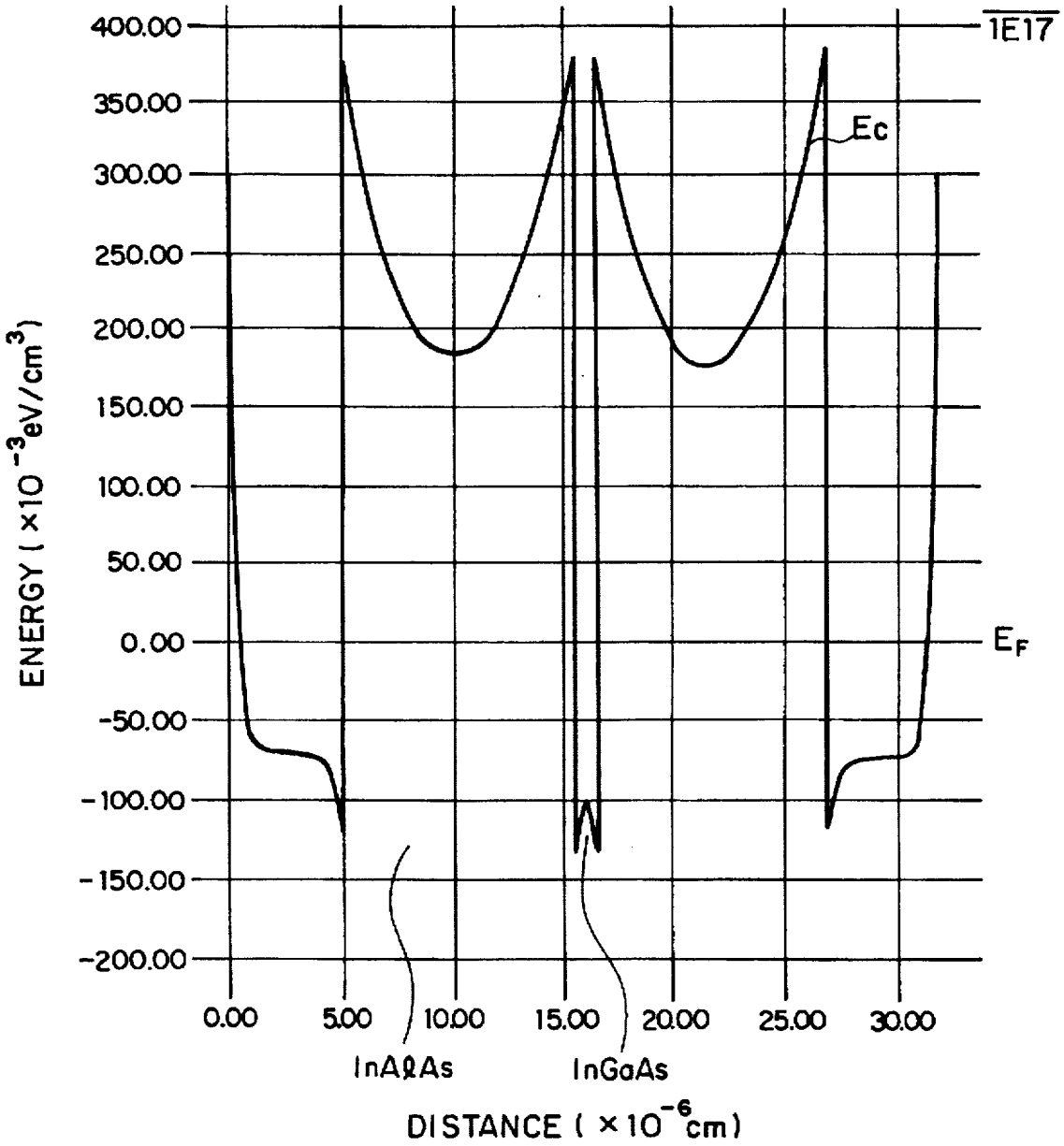
FIG. 13 is a diagram showing an energy band manifested by a field emission cold cathode made of other material.
Figure 14:
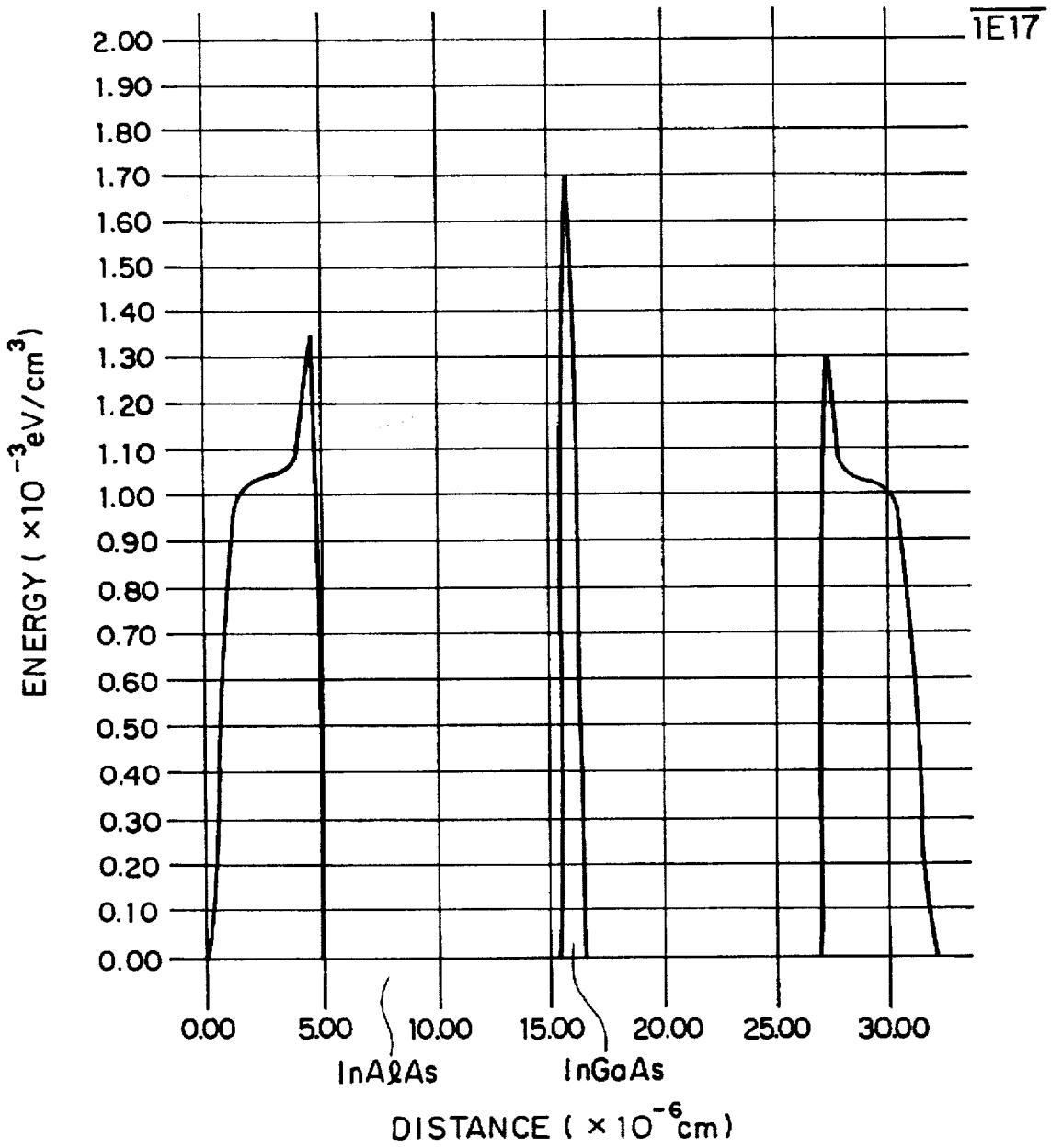
FIG. 14 is a diagram showing an electron density distribution manifested by a field emission cold cathode made of other material.

First, as respects the results of simulation using InAlAs of high doping of 1E17/cm$^3$ in a thickness of 100 nm for a wide band gap and InGaAs of high purity of 2E15/cm$^3$ in a thickness of 10 nm for a narrow band gap, the energy band pattern is shown in FIG. 13 and the distribution of electron density in FIG. 14.

As shown in the diagram, the combination of InGaAs/InAlAs has a high barrier (0.5 eV). By causing the Fermi level EF to surpass EC by a margin of 0.1 eV and consequently decreasing the work function by means of modulated doping, therefore, the structure to be ultimately produced enables the electrons to be included only in the InGaAs layer.

By alternately superposing semiconducting materials different in band gap and adjusting them in thickness and doping level as described above, a planar field emission array combining a multiplicity of materials can be formed.

A semiconductor AlAs, 10 nm in thickness, can be used as an emitting material and an insulator $SiO_2$, 300 nm in thickness, can be used as a potential barrier. In this case, the produced structure can effect field emission at low driving voltage because the AlAs has a small electron affinity (2.6 eV). A field emission cold cathode array having a low driving voltage can be formed by using emitter layers formed of a semiconducting or metallic material of low affinity and potential barrier layers formed of an insulating material as described above.

Now, a typical application of the field emission cold cathode described above will be cited below.

Embodiment 4

Figure 15:
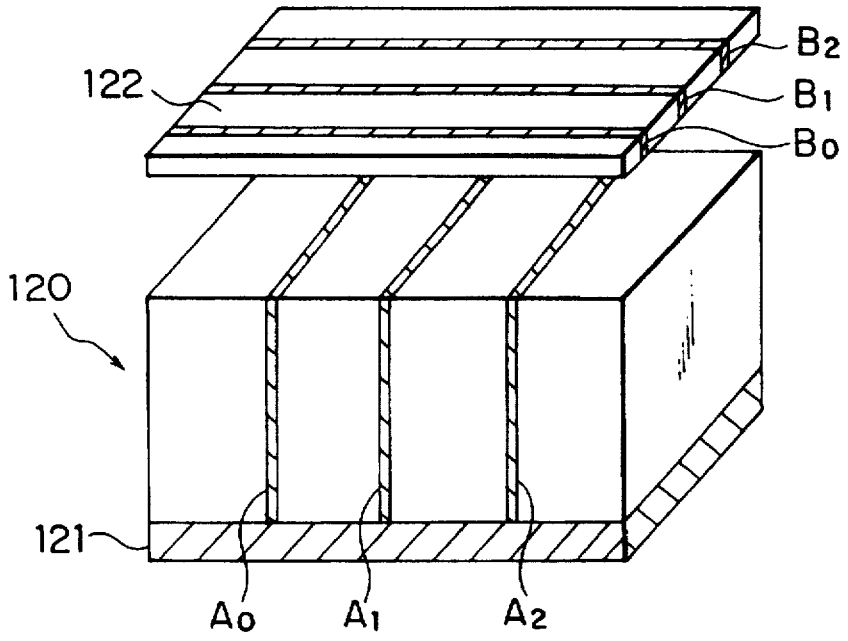
FIG. 15 is a diagram illustrating the manner in which an addressable field emission cold cathode is constructed.

FIG. 15 depicts one manner of forming an addressable field emission cold cathode. The example shown in this diagram has anode lines B0, B1, and B2 such as of A1 disposed opposite emitter lines A0, A1, and A2 of a field emission cold cathode array 120 which is formed as described above. In this diagram, 121 stands for an insulating substrate such as of $SiO_2$ and 122 for an insulating layer such as of $SiO_2$.

The planar field emission cold cathode array, by being formed in this structure, is rendered addressable and also adaptable for such devices as planar displays and ultrahigh speed devices.

Figure 16:
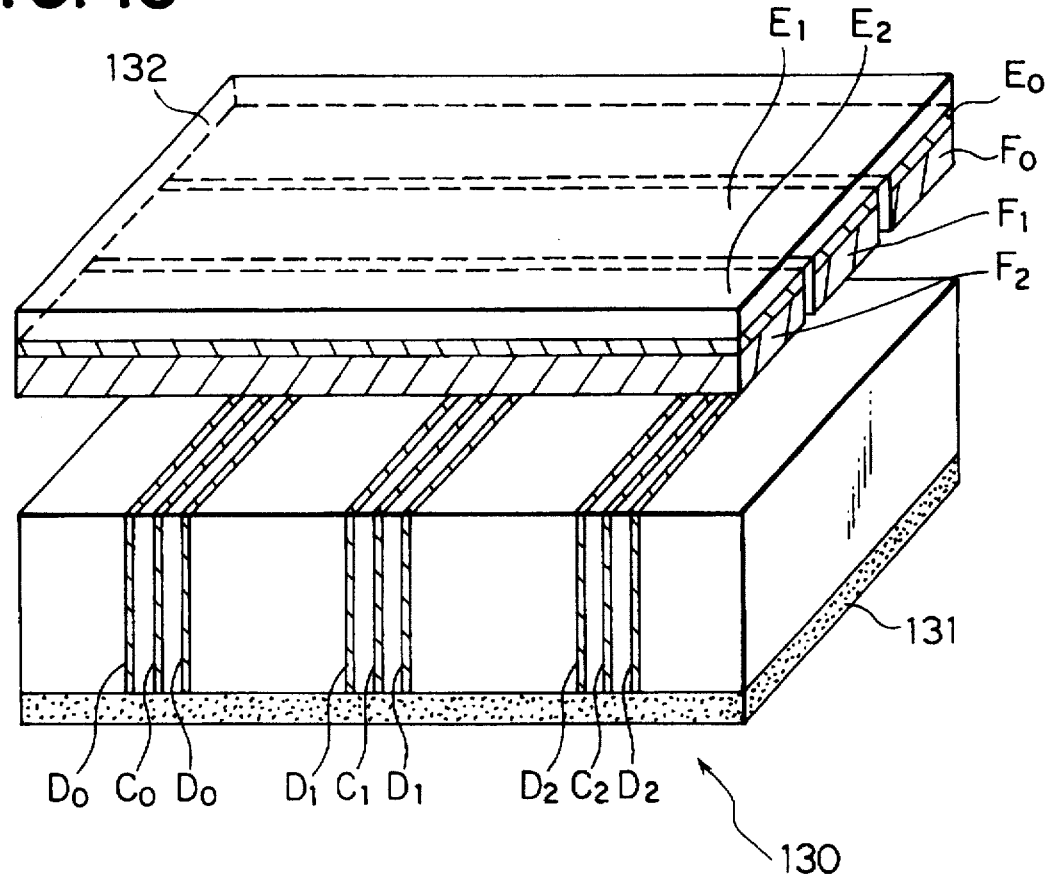
FIG. 16 is a diagram illustrating the manner in which a plane display is constructed.

FIG. 16 depicts one manner of adapting the planar field emission cold cathode array for forming a planar display. In the example shown in the diagram, emitter lines C0, C1, and C2 are formed in a field emission cold cathode array 130 and gate lines D0 and D0 are opposed to each other across the emitter line C0, gate lines D1 and D1 opposed to each other across the emitter line C1, and gate lines D2 and D2 opposed to each other across the emitter line C2 respectively. In the diagram, 131 stands for an insulating substrate such as of $SiO_2$.

A glass substrate 132 is disposed opposite the field emission cold cathode array 130. On the side of the glass substrate 132 that is opposed to the field emission cold cathode array 130, transparent electrodes E0, E1, and E2 such as of an ITO electrode are formed and phosphor layers F0, F1, and F2 are formed respectively on the transparent electrodes E0, E1, and E2. A planar display of high performance can be formed as described above.

Embodiment 4

Figure 17:
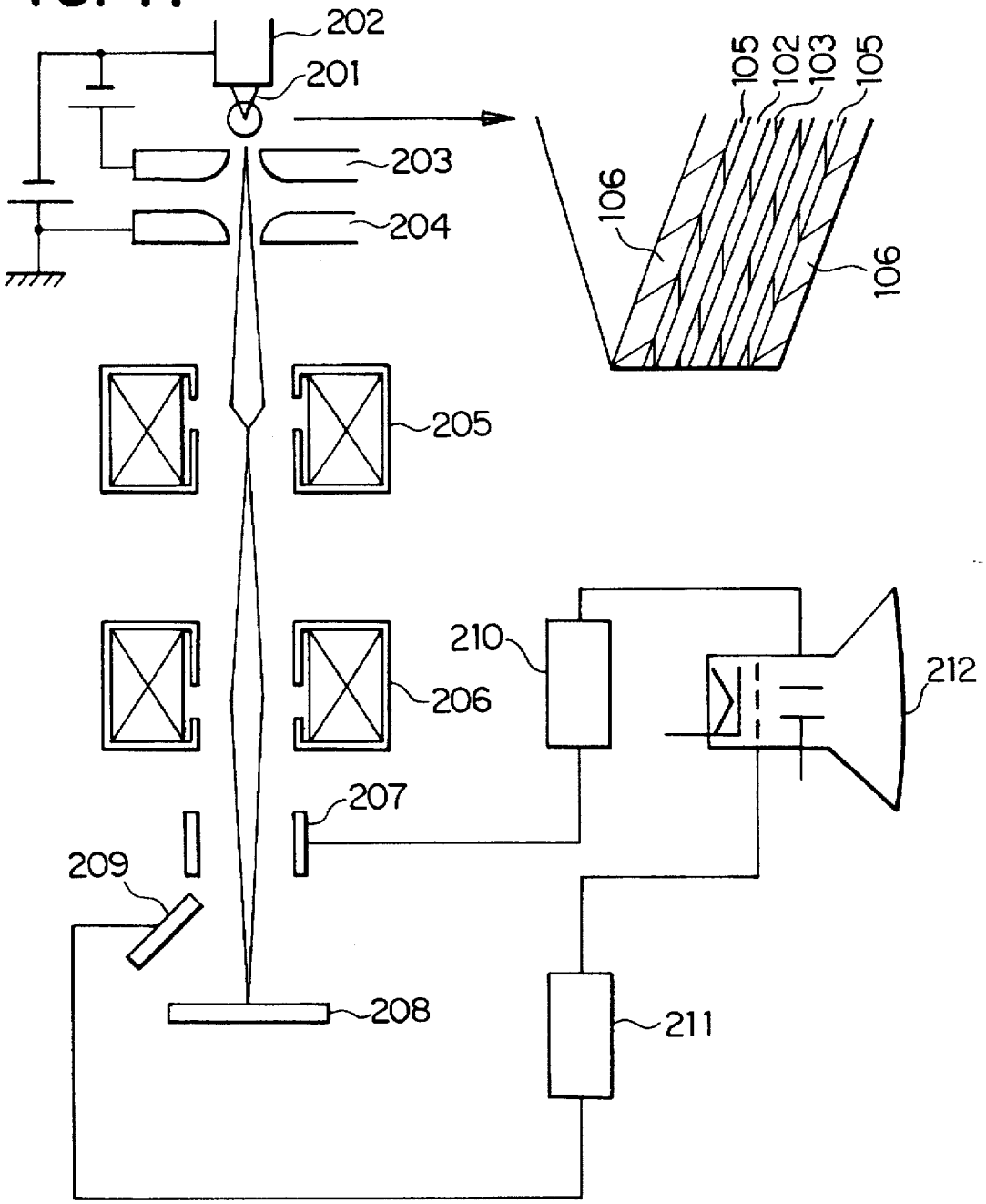
FIG. 17 is a diagram illustrating the construction of a scanning electron microscope using the field emission cold cathode of this invention.
Figure 18:
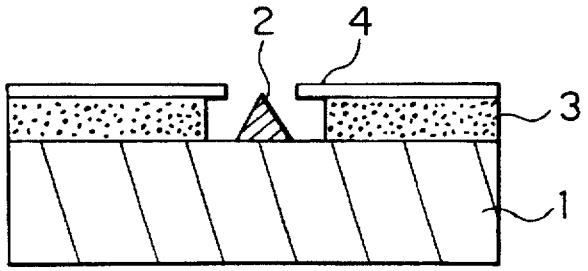
FIG. 18 PRIOR ART
FIG. 18 is a diagram illustrating the schematic structure of a conventional field emission cold cathode.

FIG. 17 depicts one manner of forming a scanning electron microscope using the field emission cold cathode of this invention.

In the example shown in this diagram, a wedged field emission cold cathode 201 is disposed on an electroconductive holder 202. The electron beam that is formed of electrons extracted by a first electrode 203 and accelerated by a second electrode 204 are converged by a first lens 205 and a second lens 206 and then caused by a polarizing electrode 207 to impinge on any position arbitrarily selected of a sample 208.

The secondary electrons which are generated by the electron beam impinging on the sample are detected by a sensor 209. An enlarged image of the sample can be obtained by scanning the surface of the sample with the electron beam by means of a scanning power source 210 and introducing the relevant signal of detection through the medium of am amplifier 211 into the intensity modulator of a braun tube 212 which is synchronized to the signal.

The field emission cold cathode of this invention is enabled to converge and polarize the electron beam accurately and produce a magnified image with high accuracy because it quantizes the energy of electrons and emits electrons of uniform energy.

According to the field emission cold cathode of the present invention and the method for the production thereof, the range of materials to be selected as usable therefor can be widened and, at the same time, the efficiency of field emission can be exalted and uniformized and the uniformity of energy can be improved as described in detail above. Since the method of production provided by this invention abounds in adaptability for mass production, it can be applied extensively to the manufacture of flat displays and other electron sources.

What is claimed is:

1. A field emission cathode comprising:

a first thin film formed of an emitting material;

and second thin films differing in composition from said first thin film, said second thin film superposed one each on each of the main surfaces of the first thin film to form a laminated structure, the lateral sides of the laminated structure exposing the lateral end parts of said first thin film and said second thin films, an exposed end part of the first thin film in the lateral end parts emitting electrons under an electric field, wherein the emitting material forming the first thin film is comprises a first semiconductor material having a narrow band-gap and the material forming said second thin films compose a second semiconductor material having a wide band-gap than said first semiconducting material, and, wherein said first thin film has a thickness for inducing an effect of quantum inclusion that allows the energy of the electron to be quantized and permits field emission of electrons of uniform energy.

2. The field emission cold cathode according to claim 1, wherein said first semiconductor is so composed that the Fermi level energy thereof surpasses the lowest energy of the conduction band and the actual work function thereof is decreased.

3. The field emission cold cathode according to claim 1, wherein the combination of said first semiconductor and said second semiconductor is one member selected from the group consisting of GaAs/AlGaAs, InP/GaInAs, InGaAs/InAlAs, GaAs/AlAs, InAs/GaSb, GaP/GaAsP, ZnSe/ZnTe, ZnS/ZnSe, Si/SiGe, and Si/SiC.

4. The field emission cold cathode according to claim 3, wherein said second semiconducting material has undergone modulated doping.

5. The field emission cold cathode according to claim 1, wherein said first thin film is formed of a metallic material and, at the same time, said second thin films are formed of a dielectric material.

6. The field emission cold cathode according to claim 5, wherein said metallic material is one member selected from the group consisting of Mo, W, Hf, Pt, Au, Nb, Cr, and Ta and said dielectric material is one member selected from the group consisting of $SiO_2$ and $Al_2O_3$.

7. The field emission cold cathode according to claim 1, wherein said first thin film has an approximate thickness of not more than 10 nm and said second thin films have a thickness of not less than 100 nm.

8. The field emission cold cathode according to any one of claims 2, 6 or 7, wherein said laminated structure has said first thin film formed of an emitting material and said second thin films alternately superposed in a plurality of layers.

* * * * *

UNITED STATES PATENT AND TRADEMARK OFFICE

CERTIFICATE OF CORRECTION

PATENT NO. : 5,721,467

DATED : February 24, 1998

INVENTOR(S) : Li Zhang et al.

It is certified that error appears in the above-indentified patent and that said Letters Patent is hereby corrected as shown below:

Claim 1, column 10, line 5, "film" (second occurrence) should read --films--;
lines 12-13, "is comprises" should read --comprises--;
line 15, "compose" should read --comprises--; and
line 16, "wide" should read --wider--.

Claim 8, column 10, line 51, "2, 6 or 7" should read --1, 2-6 or 7--.

Signed and Sealed this

Sixth Day of April, 1999

*Attest:*

Q. TODD DICKINSON

*Attesting Officer*

*Acting Commissioner of Patents and Trademarks*